US005794388A

United States Patent [19]

Jackman

[11] Patent Number: 5,794,388

[45] Date of Patent: Aug. 18, 1998

[54] APPARATUS FOR CONTROLLING WATER SEEPAGE AT A STRUCTURAL INTERFACE

[76] Inventor: Robert Jackman, 12920 W. Francis Rd., Mokena, Ill. 60448

[21] Appl. No.: 846,819

[22] Filed: Apr. 30, 1997

Related U.S. Application Data

[63] Continuation-in-part of Ser. No. 520,552, Aug. 29, 1995, Pat. No. 5,630,299.

[51] Int. Cl.[6] ..... E04B 1/70; E04F 17/00

[52] U.S. Cl. ..... 52/169.5; 52/302.1; 405/36

[58] Field of Search ..... 52/169.5, 169.14, 52/302.1; 405/36, 48, 49

[56] References Cited

U.S. PATENT DOCUMENTS

| | | | |
|---|---|---|---|
| 3,283,460 | 11/1966 | Patrick | 52/169.5 X |
| 3,654,765 | 4/1972 | Healy et al. | 52/169.5 X |
| 3,850,193 | 11/1974 | Guzzo | 52/169.5 X |
| 4,745,716 | 5/1988 | Kuypers | 52/169.5 |
| 4,840,515 | 6/1989 | Freese | 52/169.14 X |
| 5,044,821 | 9/1991 | Johnsen | 52/14 X |
| 5,383,314 | 1/1995 | Rothberg | 52/169.5 |
| 5,501,044 | 3/1996 | Janesky | 52/169.5 |
| 5,630,299 | 5/1997 | Jackman et al. | 52/169.5 |

*Primary Examiner*—Robert Canfield
*Attorney, Agent, or Firm*—Dvorak & Orum

[57] ABSTRACT

A method and apparatus for controlling water seepage at an interface between a wall supported by a footing and a floor with a side surface adjacent the wall and a bottom surface adjacent the footing using a pliable panel disposed between the wall and the side surface of the floor and between the footing and the bottom surface of the floor to substantially isolate the floor from the wall and the footing. The panel including a water flow path between the wall and the side surface of the floor and between the footing and the bottom surface of the floor, wherein the pliable panel permits expansion and contraction of the floor, walls and footing.

7 Claims, 6 Drawing Sheets

APPARATUS FOR CONTROLLING WATER SEEPAGE AT A STRUCTURAL INTERFACE

This application is a continuation-in-part of U.S. patent application Ser. No. 08/520,552 filed on Aug. 29, 1995, now U.S. Pat. No. 5,630,299.

FIELD OF THE INVENTION

The present invention relates to a method and apparatus for controlling the flow of water seepage and moisture at an interface of two or more abutting building structures, and in particular for controlling water leakage at an interface of a subterranean foundation wall, footing and floor while and at the same time permitting sufficient expansion and contraction of the wall, footing and floor to prevent damage thereto.

BACKGROUND OF THE INVENTION

Building structures like walls of concrete block or poured concrete tend to absorb moisture which over time adversely effects their structural integrity. Subterranean foundation walls are especially at risk, particularly in buildings under construction and in geographic areas of high precipitation or with inadequate water drainage through local ground soil. Water accumulation on an external surface of a subterranean foundation wall can result in significant hydraulic pressure on the wall which may cause severe structural damage. Subterranean water below a basement floor may also produce hydraulic pressure causing the floor to heave and shift laterally which may likewise result in severe structural damage. In some instances water rises above and flows over the wall into the interior basement and, more commonly, water and moisture seep through form tie rod holes and cracks in the walls and floor. In any event, water seepage causes structural damage and even small amounts of moisture can irreparably damage architectural and interior appurtenances as well as personal property. Water and moisture may also seep into the interior basement through an interface between the foundation wall and an adjacent footing which supports the wall. This is especially true when the basement floor forms a bond with the footing preventing water from flowing between the footing and the floor bottom toward a drain in the porous fill below the floor. This results in water being forced, by external pressure, up between the floor and the wall and into the basement. It is not uncommon to apply a vapor barrier between the bottom of the floor and the porous fill on which the floor is poured, and in some cases the vapor barrier does help to reduce bonding between the floor and the footing permitting the water to flow into the fill where it is eliminated through the inside drainage system. In most instances however the vapor barrier is not installed along the entire bottom of the floor, and in any event the barrier does not provide for unobstructed drainage of water to the water drainage system below the floor. It is therefore important to prevent water accumulation on either side of the walls and floor to reduce hydraulic pressure and to prevent water and moisture seepage through structural interfaces and into the interior basement. As a practical matter, however, it is only possible to reduce hydraulic pressure and to reduce water seepage as discussed below. It is also important to control water and moisture that seeps through the structural interfaces, cracks, form tie rod holes, honeycombed concrete, and over the wall structure to prevent accumulation of water and moisture on the basement floor.

It is well known to provide a drainage conduit or the along the outer perimeter which directs water away from the wall and into a sewer or drainage system to relieve hydraulic pressure on the wall. It is also known to provide a similarly arranged drainage conduit about the perimeter of the interior of the wall and below the basement floor. Water drainage on the exterior surface of the wall has been improved upon by disposing a system of panels against the exterior surface of the wall to form a water barrier. In subterranean or underground foundation walls, the panels are usually located between the outer foundation wall and ground fill and extend from the top to the bottom of the wall often extending over the foundation footing. The panels are generally formed of a waterproof material and include protrusions extending toward the outer foundation wall surface to form an air space between the panel and the wall, and vertically arranged channels or conduits along an outer surface of the panel which direct water downward and away from the foundation wall toward the drainage system to reduce hydrostatic pressure. A variety of methods for adhering the panels to the wall and for interconnecting the adjacent panels are also known. In some systems, panels are adhered to the walls by an adhesive and adjacent panels are interconnected by waterproof joints often including flashing along an upper edge to provide a more waterproof barrier. More sophisticated systems include a water permeable filter layered on an outer surface of the panels which allows passage of water through the filter toward the drainage channels of the panels but prevents the passage of particulate matter which may clog or obstruct the channels and the drainage system. Systems of panels applied to the exterior wall surface however are intended primarily for providing a water barrier which protects the exterior surface of subterranean foundation walls from water in the ground fill. Such an exterior panel system provides an exterior water barrier which relieves hydraulic pressure and waterproofs the walls in the first instance. But it does not address the problem of controlling water which traverses the barrier or seeps through structural interfaces and cracks. Further, exterior panels do not prevent nor control water that has flowed over the foundation wall or control subterranean water that seeps through the interface between the foundation wall and the footing for lack of adequate drainage cause by clogged drain tiles or compromises in the waterproofing of the exterior panel.

One proposal for controlling water which seeps into the interior basement by flowing over the wall, through cracks in the wall, or through the interfaces between the wall and footing includes providing an L-shaped corrugated panel between a side surface of the floor adjacent the interior wall and a bottom surface of the floor adjacent the footing. The corrugations of the panel are arranged and aligned to permit water to flow down between the wall and the floor and then between the footing and the bottom of the floor to the drainage system below the floor. The L-shaped panel is generally comprised of sections which are arranged adjacent to one another along the interior base of the wall and footing before the concrete floor is poured. In some instances the corrugated panels are formed of a plastic, but the panels may also be formed of biodegradable materials sufficiently rigid to maintain its shape until after the concrete floor is set, and then over a period of time the biodegradable material degrades and is ultimately flushed away through the drainage system. Other embodiments include variations on the corrugation pattern which permit appropriate drainage of water. The L-shaped panel is generally formed by partially scoring or slitting through one side of the corrugation and then folding the panel along the slit. The slit panel however has the disadvantage that it permits moisture to seep through the slit and to contact and ultimately permeate the floor. The prior art panels also include portions on one side which contact the wall and the footing, and portions on an opposing side which contact the floor. The portions of the panel which contact wall and the footing allow substantial portions of the poured concrete floor to come into contact with the wall and footing, through the panel, for the explicit purpose of preventing movement or shifting of the floor which allegedly prevents cracking of the walls, footing and floor. In a system of these corrugated panels, a series of spaced water conduits is formed and extends between the interior wall, footing and floor to direct water to the drainage system below the floor. Between the spaced water conduits the side of the floor is in abutment with the wall and the bottom of the floor is in abutment with the footing, acting of course directly through the panels and resulting in the substantial contact between he floor and the walls and footing. This substantial contact however has the disadvantage that the floor is not able to expand and contract without causing cracking. More specifically, the contact between the sides of the floor and the interior wall surface tends to prevent expansion of the floor which may result in buckling of the floor and shifting or cracking of the walls. Further, the substantial contact between the floor and the footing in prior art systems results in substantial bonding or at least substantial friction which inhibits expansion and contraction. The substantial contact likewise inhibits expansion and contraction of the walls and footing which may also result in cracking, improper shifting and heaving. Moreover, absent an ability to expand and contract, the interior basement floor becomes locked and is especially vulnerable to cracking at its corners. These problems are particularly severe during construction and in regions of extreme temperature and moisture variation where expansion and contraction of concrete is most significant. It is therefore not only important to control water flow at structural interfaces, but also to permit expansion and contraction of structural components like walls, footings and floors.

In view of the discussion above, there exists a demonstrated need for an advancement in the art of controlling water and moisture at a structural interface, and in particular in subterranean environments.

It is therefore an object of the invention to provide a novel method and apparatus for controlling water and moisture at a structural interface while permitting expansion and contraction of the structure.

It is another object of the invention to provide a novel method and apparatus for controlling water and moisture at a structural interface while permitting expansion and contraction of the structure that is economical and easy to install.

Accordingly, the present invention is directed toward a novel method and apparatus for controlling water at an interface between a wall supported by a footing and a floor with a side surface adjacent the wall and a bottom surface adjacent the footing with a pliable panel disposed between the wall and the side surface of the floor and between the footing and the bottom surface of the floor to substantially isolate the floor from the wall and the footing. The panel includes a water flow path between the wall and the side surface of the floor and between the footing and the bottom surface of the floor, wherein the pliable panel permits expansion and contraction of the floor, walls and footing. In one embodiment, the panel includes a first layer separated from a second layer by a series of ribs which form drainage channels extending from a top portion of the panel to a bottom portion of the panel to define the water flow path, and a series of slits across the panel substantially transverse to the series of ribs. The slits extend through the second layer and at least partially through the series of ribs to permit folding of the panel along one or more of the slits to form a substantially L-shaped panel. The first layer of the panel is disposed adjacent the side and bottom surfaces of the floor, and the second layer is disposed adjacent the wall and the footing so that the fold is along an interface between the wall and footing. At least the first layer extends into crushed rock fill disposed below the floor to direct water toward a water drainage system. In an alternative embodiment, the panel includes a first layer with a film having an array of dome-shaped air pockets adhered to a backside of the first layer. Spaces between the dome-shaped air pockets define the water flow path. In another embodiment, the panel includes a first layer with a corrugated layer adhered to a backside of the first layer, wherein the corrugated layer forms drainage channels extending from a top portion of the panel to a bottom portion of the panel to define the water flow path. A series of slits are formed across the panel substantially transverse to the drainage channels formed by the corrugated layer, which extend at least partially through the corrugated layer. The panel is foldable along one or more of the slits to form a substantially L-shaped panel, the first layer disposed adjacent the side and bottom surfaces of the floor, and the corrugated layer disposed adjacent the wall and the footing so that the fold is along an interface between the wall and footing. In all embodiments, the panels preferably include a flap for directing the seepage away from the floor bottom and into crushed stone below the floor and toward the drainage system. A reference line formed on the top portion of the first layer for alignment during installation, and a mastic disposed on the upper portion of the second layer for adhering the panel to the wall during installation. The panels are all preferably formed of a pliable plastic which permits expansion and contraction of the wall, footing and floor while water is directed into the water flow path to the water drainage system.

These and other objects, features and advantages of the present invention will become apparent upon consideration of the following Detailed Description of the Invention with the accompanying drawings which are not necessarily drawn to scale to assist comprehension of the invention by those skilled in the art.

DETAILED DESCRIPTION OF THE INVENTION

Figure 1:
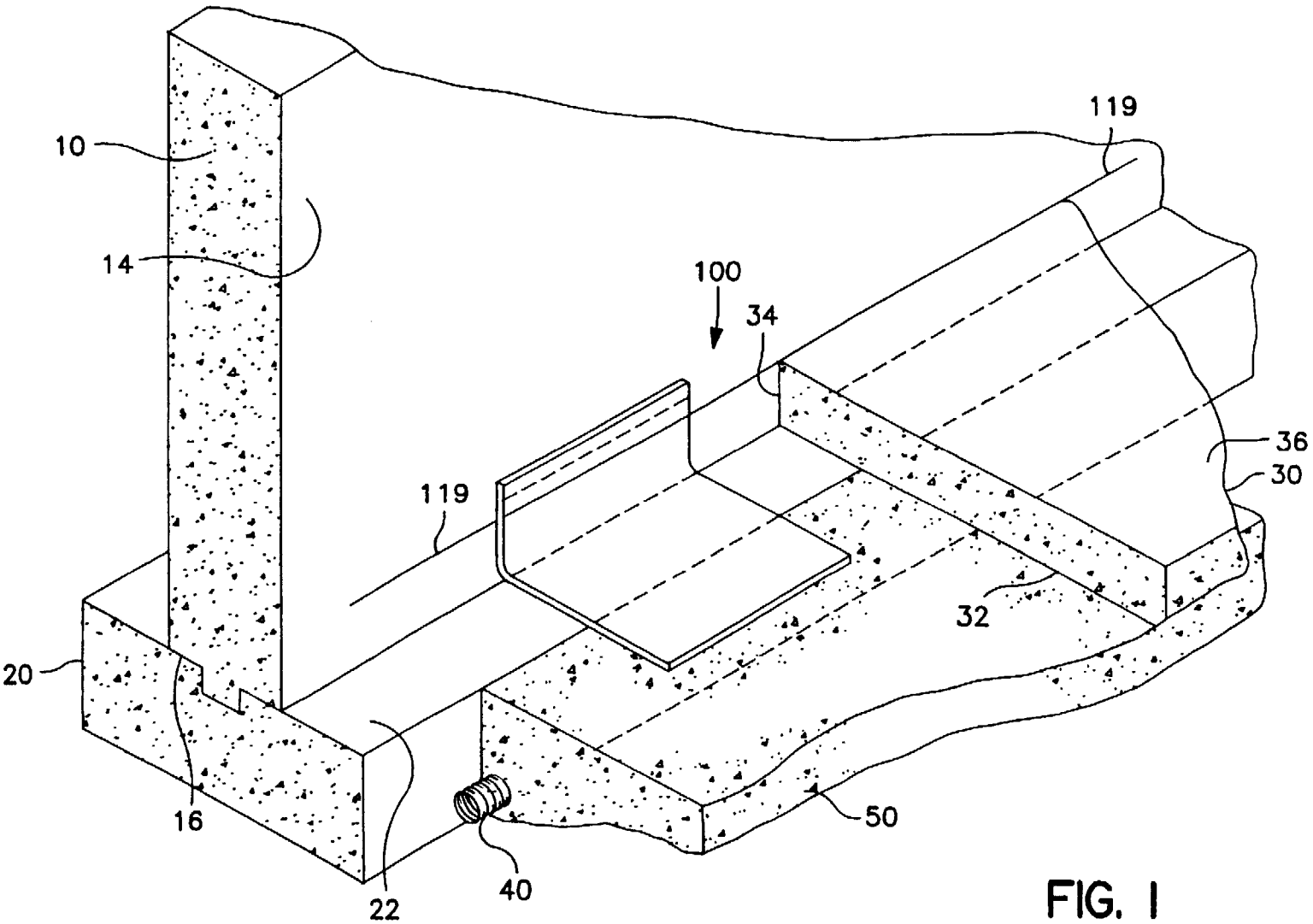
FIG. 1 is a partial perspective sectional view of a typical subterranean structural interface including a foundation wall supported on a footing and an interior floor with a drainage conduit buried in a porous material disposed below the floor including a partial sectional view of a water and moisture control apparatus according to the present invention.

FIG. 1 is a partial perspective sectional view of a typical structural interface which in an exemplary embodiment is a foundation wall 10 supported on a footing 20 which interface may include a notch to prevent or limit relative movement therebetween. The subterranean wall is generally covered on its exterior surface with a ground fill, and in any case the wall may include a water barrier and a hydraulic pressure reducing drainage system not shown in the drawing but known in the art. Absent the water control apparatus of the present invention, an interior floor 30 rests directly on the footing 20 and in abutment with the wall 10. This substantial contact severely constrains expansion and contraction of the various structural elements as discussed above. An interior drainage conduit or the 40 is buried in a porous material 50 such as crushed stone which in part supports the interior floor 30. The drain tile is generally coupled to a sewer or attendant drainage system to eliminate water accumulation below the floor by gravitation but may be also be assisted by a mechanical pump as known in the art. Water and moisture from the exterior of the wall may seep through the interface between a bottom surface 16 of the wall and the top surface 22 of the footing and then up through the interface between the foundation wall and the side surface of the floor. This is particularly true in instances where the bottom surface 32 of the floor forms a strong bond with the upper ledge 22 of the footing. Water may also flow over the top of the wall and through cracks in the wall and then run down along the wall and accumulate on the floor, especially if there is a bond between a side surface 34 of the floor and the interior surface 14 of the wall or a bond between the bottom of the floor surface 32 and the top of the footing 22. The deleterious effects of such a structural arrangement on contraction and expansion and water and moisture penetration is discussed in the Background of the Invention and requires no further elaboration.

Figure 2:
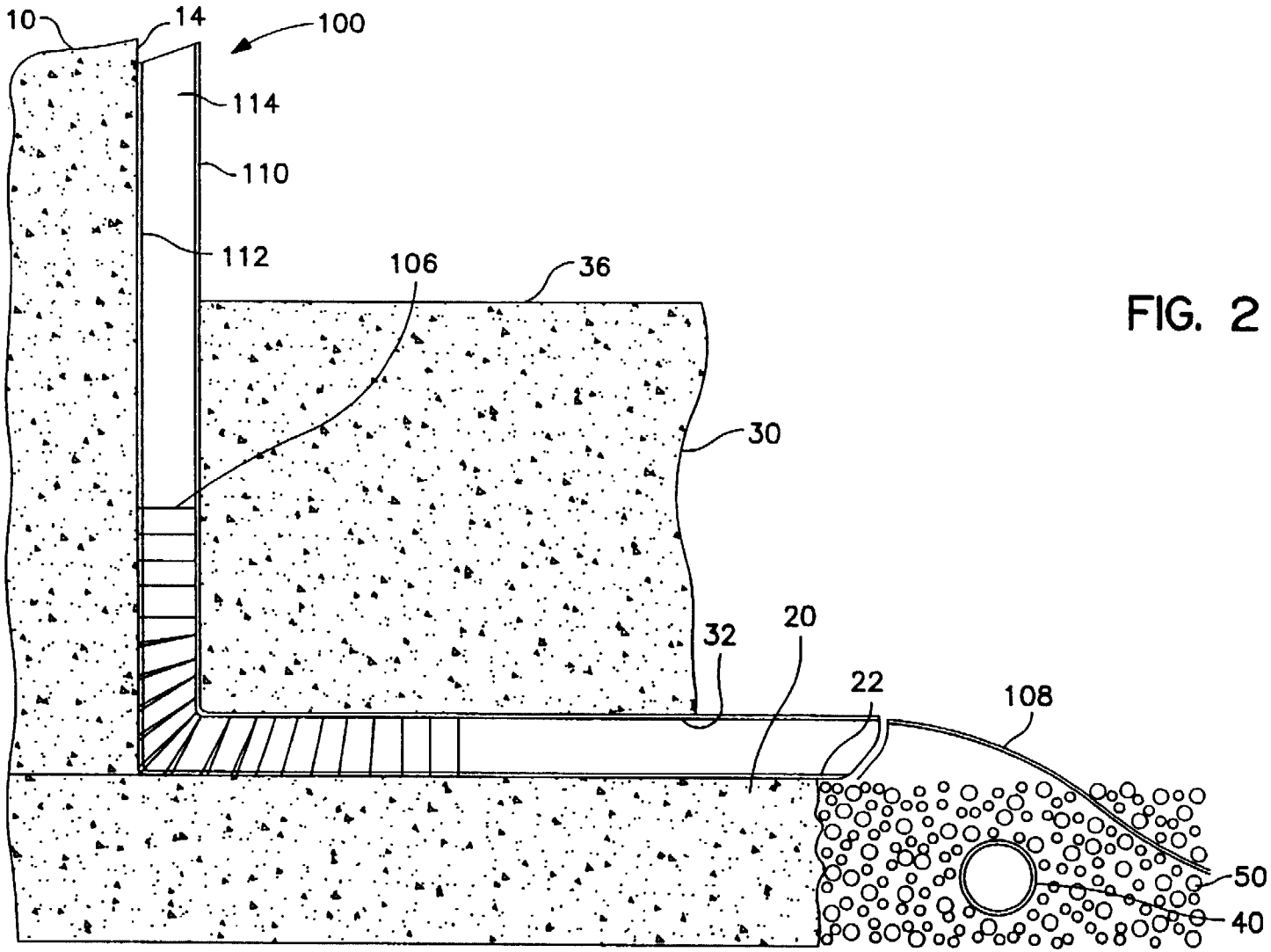
FIG. 2 is a partial sectional view of a subterranean structure and a first embodiment of a water and moisture control apparatus disposed between the wall, footing and floor.
Figure 3A:
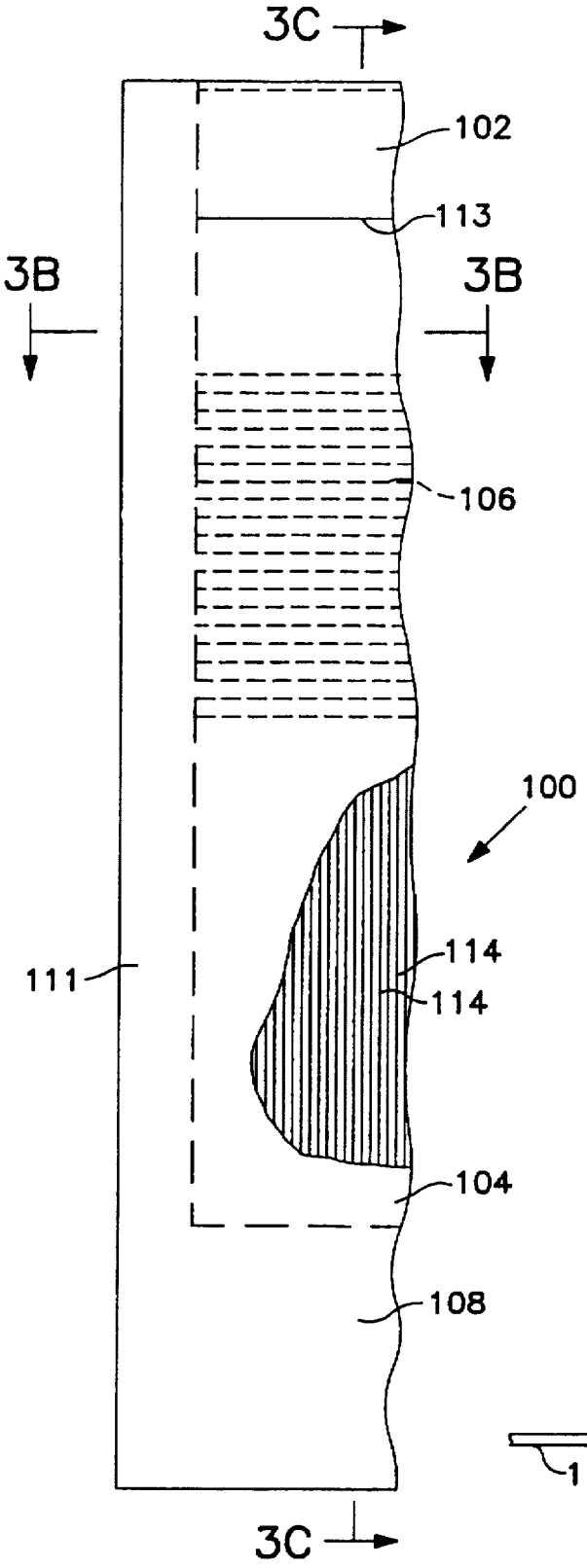
FIG. 3A is a partial top view of one embodiment of the water and moisture control apparatus according to the present invention.
Figure 3B:
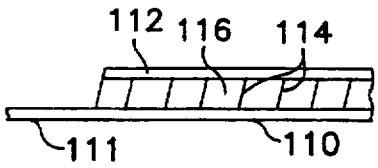
FIG. 3B is a partial sectional view of the water and moisture control apparatus according to FIG. 3A.
Figure 3C:
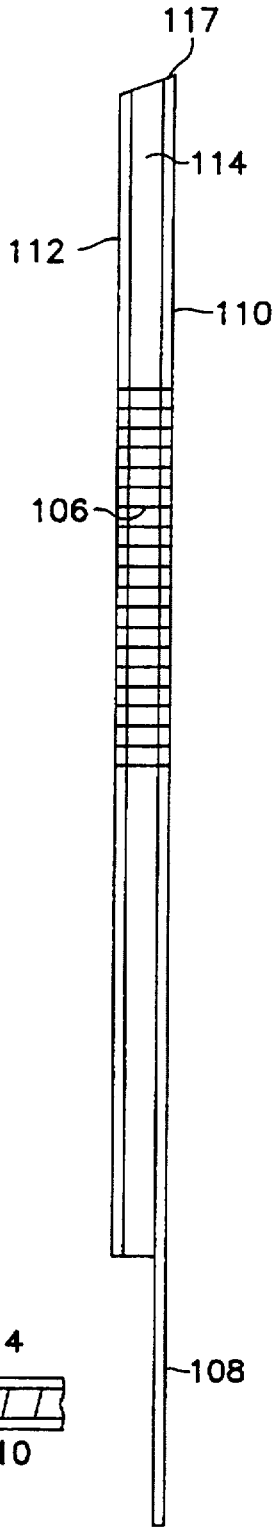
FIG. 3C is side view of the water and moisture control apparatus according to FIG. 3A.

FIG. 2 is a partial sectional view of a first embodiment of a water and moisture control apparatus 100 according to the present invention which is disposed between the wall 10, the footing 20 and the interior floor 30 to, provide a water flow path along the interfaces between adjacent surfaces of the wall, footing and floor as further discussed below. FIG. 3A is a partial top view of a portion of one embodiment of the water and moisture control apparatus in the form of a pliable and waterproof panel 100 including an upper portion 102 and a lower portion 104. FIG. 3B is a partial sectional view of the panel 100 having a first or front layer 110 and a second or rear layer 112 separated by a series of ribs 114 which form drainage channels 116, or a water flow path, arranged substantially parallel with one another and extend from the upper portion 102 toward the lower portion 104 of the panel. The first layer 110 is substantially continuous and abuts against the bottom and side surfaces 32 and 34 of the floor 30 to maintain a space between the floor and the top of the footing 22 and interior wall surface 14 to permit expansion and contraction of the structural elements. The panel however has sufficient rigidity to maintain its shape under the influence of freshly poured concrete until after the concrete floor is set as further discussed below. In one embodiment, the ribs are arranged at an angle to facilitate compression of the pliable panel during expansion and contraction of the structure. FIG. 3C is side view of the panel 100 and illustrates more clearly a series of substantially parallel slits 106 which extend through the second layer 112 and at least partially through the ribs, but preferably do not cut into the first layer 110, to permit ready shaping or folding of the panel during installation as further discussed below. A lower end portion preferably, though not necessarily, includes a flap 108 which may advantageously be formed of a portion of the first layer 110 absent the ribs 114 and second layer 112. In an alternative embodiment, a top edge of the ribs is angled from a top edge 117 of the front panel 110 toward the rear layer 112, for example a one quarter inch differential between the front and rear panels. The upper portion 102 of the panel may also include a highly visible reference line 113 formed on the front layer 110 by a bright or fluorescent colored ink or dye for use by contractors to accurately gauge floor height during pouring and grading of the concrete floor as discussed below. The upper portion 102 of the rear layer 112 may also include an area for applying an adhesive tape or mastic to adhere the panel to the wall during installation of the panel as discussed below.

The panel 100 may be economically fabricated from a readily available waterproof, resilient corrugated plastic. In one embodiment, suitable for residential applications, the panel has a height from the upper edge 117 to the lower edge of the flap of approximately 20 inches. The slits 106 are located approximately 4 to 5 inches below the top edge 117 and are spaced cover a 4 to 5 inch section of the panel. The slits 106 are separated by a distance of between approximately one eighth and one-quarter of an inch and arranged transverse to the direction of the ribs to permit ready folding and deformation of the panel during installation. The flap 108 is also approximately 4 to 5 inches in length. The panel has a width of approximately 8 ft. but may advantageously be provided in a continuous roll of lengths of 50 to 100 feet or more and having any specified width. The first and second layers 110 and 112 each have a thickness of approximately 15 mils and are separated by a distance of between approximately ⅜ of an inch. The ribs 114 likewise being separated by a distance of between approximately ⅛ of an inch. Other dimensions and materials are acceptable so long as the panel is sufficiently rigid to maintain its shape without collapsing the ribs before the poured concrete floor is set, and so long as the panel is sufficiently pliable to permit expansion and contraction of the structural elements between which it is installed while at the same time permitting an acceptable rate of water drainage through the drainage channels. The width dimension and location of the slits of course depend in part on the width of the footing 20 and the thickness of the floor 30, and the other dimensions may depend on the environment in which the panel is installed to provide adequate expansion and contraction and water drainage.

FIGS. 1 and 2 illustrate one mode of installation in which, a system of pliable panels are installed along an interface between wall 10 and footing 20 and the interior floor 30 of a subterranean foundation structure so that the floor is substantially isolated from the walls and footing by the system of panels which form a series of water conduits therebetween and at the same time permit expansion and contraction of the walls, footing, and floor. The panels are installed after the footing and wall have been constructed, but before the concrete floor has been poured. The panels are folded along one or more slits 106 and arranged so that the top portion 102 of the panel is positioned adjacent to a lower portion of the interior wall surface 14. The panels may be adhered or otherwise secured to the wall by a mastic, tape, nails or suitable mechanical fastening means. The panel 100 is advantageously installed in relation to a chalk line 119 placed on the wall and used as a reference by contractors for grading the floor. In a typical residential application, the floor is approximately four inches thick, although the thickness may vary in some areas depending on variations in the footing. The reference line 113 on the panel therefore may be aligned in relation the chalk line 119 to ensure proper installation. The plurality of slits 106 on the panel enables the fold of the panel to be seated substantially continuously along the corner between the footing and the wall despite the existence of irregularities in the level of the footing. In one embodiment, the reference line 113 is located approximately two inches below the upper edge 117 of the front layer 110 so that an upper portion of the panel protrudes above a top surface 36 of the floor as shown in FIG. 1. The upper portion of the panel may later be cut so that the front layer is substantially level with the top surface of the floor and so that the rear layer is slightly below the floor to facilitate drainage. A temporary covering, for example a removable tape or a removable portion of the panel, may be disposed over the top portion of the ribs to prevent concrete from clogging the drainage channels during installation of the concrete floor. The panels are preferably arranged as a continuous system about the interior perimeter of the wall, footing and floor interface. Gaps in adjacent panels or discontinuities in a continuous roll of panel may be eliminated by forming a lateral flange portion 111, on the order of an inch or so, on one side of each panel. The flange is advantageously formed as part of the front layer 110 absent the ribs and rear layer 112. The lateral flange Ill overlaps an adjacent panel to provide a seal which prevent the poured concrete floor from directly contacting the footing and walls thereby minimizes bonding therebetween. Tape may be applied over any seams to accomplish the same purpose or enhance the seal. Discontinuities between panels located in corners may be eliminated by removing an appropriate wedge section from a portion of the panel on the footing and overlapping adjacent panels with tape or lateral flange portions. The flap 108 of the panel is directed out beyond the footing 20 and over the crushed stone 50. Preferably, the flap is directed downwardly and at, least partially buried in the stone to direct water toward the drainage system. In areas where the footing width extends beyond the end of the panel, as in a fire place footing, the installer may interleave and overlap an additional section of panel with the installed panel flap 108 to extend the panel width.

In operation, any water flowing over the wall or through cracks in the wall and down along the wall interior surface 14 will flow into the drainage channels 116 of the panel 100 between the interior wall surface 14 and the side surface 34 of the floor. The drainage channels between the bottom of the floor 32 and the top of the footing 22 will direct the water into the crushed stone 50 where it will pass to the drainage system. The upper layer 110 of the panel adjacent to the side surface 34 and bottom surface 32 of the floor is preferably continuous to prevent water and moisture from contact with the floor as the water is directed between the wall, footing and floor into the crushed stone. The flap 108, partially buried in the crushed stone, further directs water toward the drainage system. Any water flowing from between the bottom 16 of the wall and the top of the footing 22 from the exterior side of the wall is also directed into the drainage channels 116 of the panel between the bottom surface of the floor 32 and the top of the footing 22 and into the crushed stone and toward the drainage system. In this case, water enters the drainage channels 116 through the slits 106 through the rear layer 112 of the panel. The crushed stone and attendant water drainage system generally provide an area of low hydraulic pressure below the floor which promotes drainage of the water below the floor rather than onto the floor. To accommodate relative expansion and contraction of the floor footing and walls, the pliable panel 100 is compressible and has a tendency to return to it uncompressed configuration. The pliable panel permits expansion and contraction of the wall, footing and floor while water is directed into the water flow path without substantially impeding the flow of water into the water drainage system. In the embodiment of FIG. 3, the ribs 114 are formed on a slight angle in relation to the front layer 110 and rear layer 112 to more be readily compressed under expansive forces of the adjacent structure while directing water flow in the water drainage channels.

Figure 4B:
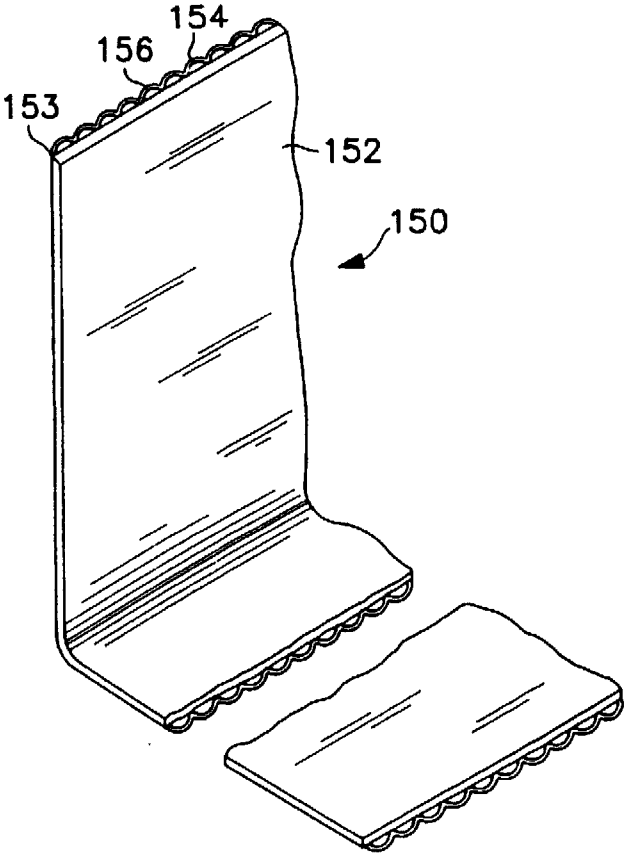
FIG. 4B is a water and moisture control apparatus according to another alternative embodiment of the invention.
Figure 4A:
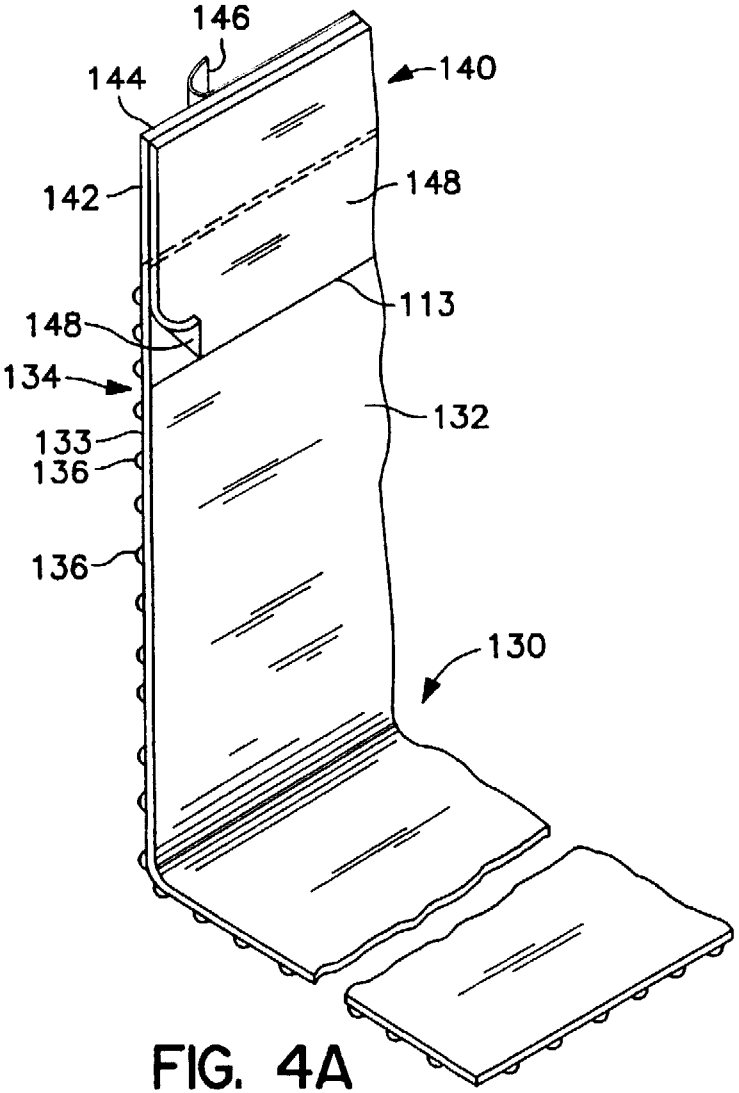
FIG. 4A is a water and moisture control apparatus according to an alternative embodiment of the invention.
Figure 4C:
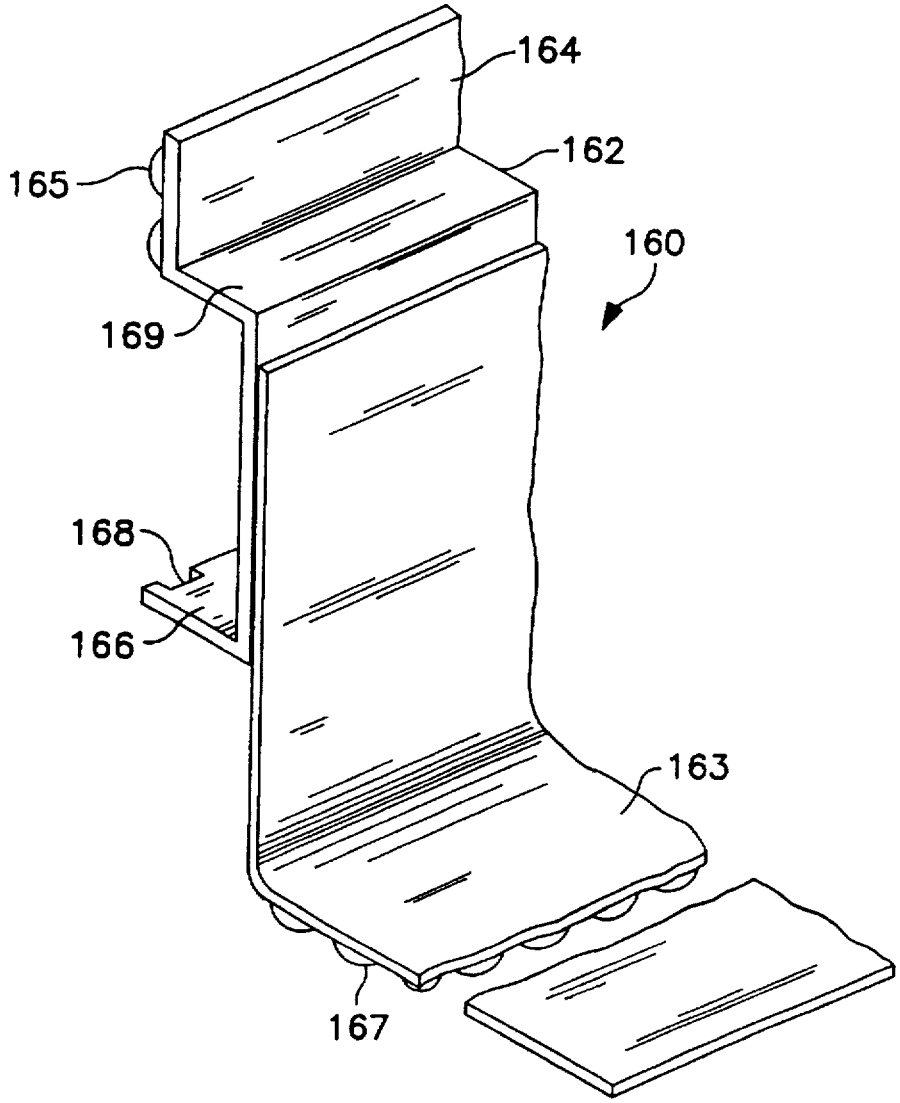
FIG. 4C is a water and moisture control apparatus according to yet another alternative embodiment of the invention.

FIG. 4A is a water and moisture control apparatus according to an alternate embodiment of the invention, wherein a panel 130 includes a substantially continuous first or front layer 132 having a film 134 with an array of dome-shaped air pockets 136 laminated or otherwise fused to a backside 133 of the first layer. The front layer 132 is preferably formed of a plastic material with a thickness between 20 and 30 mils, and the bubble sheet 134 preferably includes air bubbles on ½ inch centers similar to standard plastic bubble pack material commonly used to protect packaged goods in the shipping industry. The dome-shaped air pockets define therebetween a water flow path to permit drainage of water between the wall, footing and floor, and the dome-shaped air pockets are pliable to permit expansion and contraction of the adjacent structure as discussed above. The panel 130 does not require slits for forming an L-shaped panel. During installation the dome-shaped bubbles are sufficiently deformable and spaced to permit folding of the panel without obstructing the water flow paths. FIG. 4B is a water and moisture control apparatus according to an alternate embodiment of the invention, wherein a panel 150 includes a substantially continuous first or front layer 152 having a serpentine shaped corrugated layer 154 laminated or fused to a backside 153 of the first layer. The front layer and the corrugated layer are preferably formed of a plastic material with a thickness between 20 and 30 mils. The corrugated layer forms a series of drainage channels 156 which define a water flow path to permit water drainage between the wall, footing and floor, and the corrugations are pliable to permit expansion and contraction of the adjacent structure as discussed above. The corrugated layer 156 includes a series of slits, as in the panel of FIG. 1, which at least partially extend through the corrugations but do not extend through the front layer 152 to permit forming an L-shaped panel required for installation. The corrugated panel is likewise pliable to permit expansion and contraction of the adjacent structure. FIG. 4C is a water and moisture control apparatus according to yet another alternative embodiment of the invention, wherein a panel 160 includes a channel shaped compressible member 162 with a flange portion 164 having on a rear surface thereof a plurality of dimples 165 arranged in an array which provides a water flow path between the rear surface and the inner wall surface 14 adjacent to which the flange is positioned, preferably by nails. A lower member 166 is also positioned adjacent the inner wall surface 14 and includes a series of drain holes 168 which permit the downward flow of water along the wall toward the footing. The channel-shaped member 162 includes attached to a front surface thereof a flexible polyethylene layer 163 approximately 6 mils thick which includes on a lower surface thereof a film 167 having dome-shaped bubbles as discussed above. The member 162 is preferably formed of a plastic material of sufficient rigidity to retain its shape during installation of the concrete floor yet pliable to permit expansion and contraction of the adjacent structure. A step portion 169 is preferably aligned with the top surface 36 of the floor and therefore provides a ready reference for grading the floor. In the alternative embodiments, the front panels are substantially continuous to prevent water from permeating into the floor, and include a flap portion extended into the crushed stone to direct the water into the drainage system. The panels may also include flanges for overlapping portion of adjacent panel during installation and may have dimensions similar to the dimensions disclosed for the first embodiment.

In one embodiment, the water and moisture control apparatus according to the present invention is installed with the assistance of an installation strip 140 illustrated in combination with the embodiment of FIG. 4A, but equally applicable to the other embodiments. The installation strip includes a strip member 142 with an adhesive backing 144 covered by a removable protector strip 146. The installation strip 140 is coupled to the panel by a removable connecting tape 148 that overlaps a front surface 149 of the panel and the strip member 142. To install the panel, the removable protector strip 146 is removed to expose the adhesive backing 144 which is adhered to the interior wall surface 14 as discussed above. After the floor concrete is poured and set, the connecting tape 148 is removed from the panel and the strip 140. The strip 140 is then removed from the wall. The installation strip 140 provides not only a convenient and ready means for positioning the panel on the wall prior to pouring of the floor, but it also prevents concrete from clogging the drainage channels.

Figure 5:
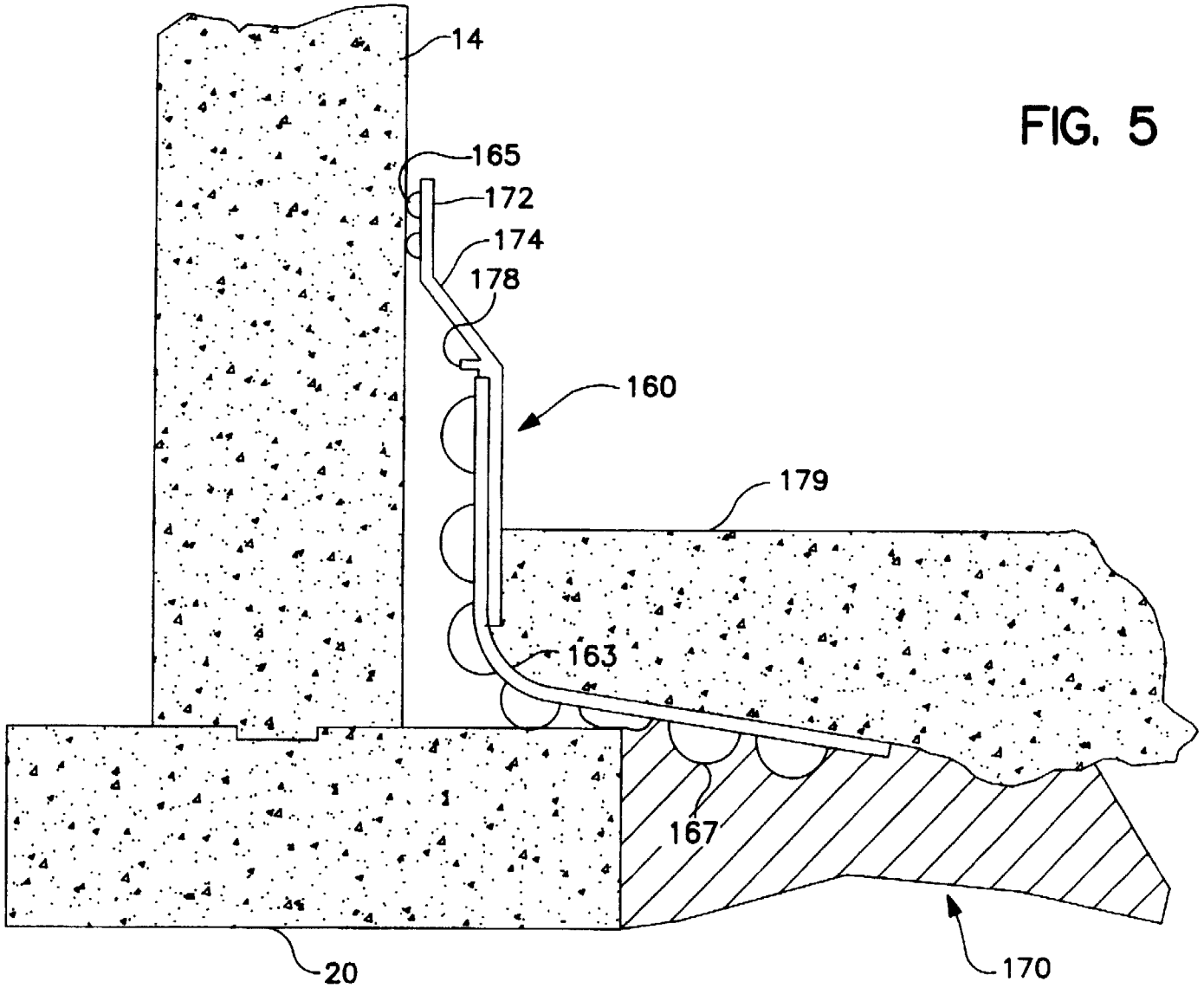
FIG. 5 is a further modification of the embodiment shown in FIG. 4(C).

FIG. 5 is a further embodiment of the water moisture control apparatus of the present invention.

In this embodiment, panel member 160 includes a flexible layer strip 174 having an offset angular extruded member 172. The back upper portion of member 172 has a plurality of protruding dimples 165 arranged to prevent the rear surface of member 172 from directly contacting the wall 14.

A running ledge 178 is disposed on the back side of the panel member.

A flexible polyethylene film strip 163 with bubbles integrally disposed on one surface, that is the "bubble pack" sheet, is attached by adhesive to the backside of the panel member 160 in a position extending downwardly from the ledge 178. The bubbles 167 on the flexible film strip, 163 form a spacer preventing contact of the lower portion of the panel member 160 from contacting the wall 14. The bubble back sheet or film strip 163 extends downwardly around the bottom of the panel member 160 to the top surface of the footing 20, and then extending away from the wall and footing 20 for a nominal distance. As can be seen in this embodiment, the concrete floor 179 is poured over the base 170 which includes a water dispersing aggregate and gravel. The structure prevents the edge of the floor 179 from direct contact with the wall 14 or the footing 20. There is thereby provided a clear passage for water condensed on the wall or seeping through the juncture of the wall and the footing, and this water is diverted to the sub-surface base 170 under the concrete flooring. Since the floor 179 does not contact the wall 14, a degree of expansion space exists between the edge of the floor and the wall to avoid buckling when the floor expands. The panel member 160 is secured to the wall by tape or securing means such as nails or staples for the purpose of maintaining the position of the panel member until the floor is poured and solidified, after which the position is secure. The bubble pack sheet or film strip 163 is attached to the flexible layer strip 174 by means of an appropriate adhesive. In this embodiment, this attachment is to the side of strip 174 which faces the wall. In an alternative form, the sheet or film strip 163 may be attached to the side of the strip 174 which faces away from the wall.

The foregoing is a description enabling those skilled in the art to make and use the preferred embodiments of the present invention, and it is to be understood and appreciated that there exists variations, modifications and equivalents to the exemplary embodiments disclosed herein. The spirit and scope of the invention therefore is to be limited only by the appended claims.

What is claimed is:

1. An apparatus for use in controlling water seepage at an interface between a wall supported by a footing and a floor with a side surface adjacent the wall and a bottom surface bearing on the footing, and for providing a means to avoid buckling of the floor due to heat expansion, the apparatus comprising panel means intended to be interposed between the wall and the side of the floor and between the footing and the bottom surface of the floor to provide a water passage spacing therebetween, the panel means comprising a flexible layer strip and an attached film strip having an array of domed-shaped air pockets disposed on one of its sides, to produce a water flow path in the space between the domed-shaped air pockets, the flexible layer strip being adapted to be mounted adjacent to the wall but spaced therefrom and from the footing, the film strip being attached to a side of the flexible layer strip, and extending downwardly therefrom.

2. The apparatus of claim 1 wherein the flexible layer strip has a front side and a backside, said film strip with the array of dome-shaped air pockets being adhered to the backside of the flexible layer strip, the film strip being bendable to form an L-shaped panel, the non-air pocket and front side of the film strip being juxtaposed to the side and bottom surfaces of the floor, a lower portion of the panel means extendable into crushed rock disposed below the floor to direct water toward a water drainage system.

3. The apparatus of claim 2, wherein flexible layer strip is formed of a pliable plastic material with a thickness between 20 and 30 mils, and the film strip is formed of a plastic material with air bubbles on ½ inch centers.

4. Apparatus as claimed in claim 1 wherein the film strip is secured to the side of the flexible layer strip which is adapted to face the wall.

5. Apparatus as claimed in claim 1 comprising protruding means on the flexible layer strip to provide a water flow spacing between the flexible layer strip and the wall.

6. Apparatus as claimed in claim 1 wherein the lower portion of the flexible layer strip is off-set to extend farther away from an adjacent wall surface than does the upper portion of the flexible layer strip.

7. Apparatus as claimed in claim 1 comprising a ledge formed on the flexible layer strip to provide an upper limit position for the attached film strip.

* * * * *